US012338621B2

(12) United States Patent
Pospisil et al.

(10) Patent No.: US 12,338,621 B2
(45) Date of Patent: Jun. 24, 2025

(54) STRUCTURAL LOAD-BEARING WALL

(71) Applicant: UNITED STATES GYPSUM COMPANY, Chicago, IL (US)

(72) Inventors: Frank Pospisil, Oak Park, IL (US); James M. Ullett, McHenry, IL (US)

(73) Assignee: UNITED STATES GYPSUM COMPANY, Chicago, IL (US)

( * ) Notice: Subject to any disclaimer, the term of this patent is extended or adjusted under 35 U.S.C. 154(b) by 234 days.

(21) Appl. No.: 17/823,409

(22) Filed: Aug. 30, 2022

(65) Prior Publication Data

US 2024/0068229 A1 Feb. 29, 2024

Related U.S. Application Data

(60) Provisional application No. 63/245,782, filed on Sep. 17, 2021.

(51) Int. Cl.
*E04B 2/56* (2006.01)

(52) U.S. Cl.
CPC ..... *E04B 2/56* (2013.01); *E04B 2103/02* (2013.01); *E04B 2103/04* (2013.01)

(58) Field of Classification Search
CPC .... E04B 2/56; E04B 2103/02; E04B 2103/04; E04B 2/7457; E04B 1/08; E04B 1/14
See application file for complete search history.

(56) References Cited

U.S. PATENT DOCUMENTS 2,276,244 A 3/1942 Fischer et al.
2,446,644 A 8/1948 Fischer
3,115,431 A 12/1963 Stokes et al.
3,214,311 A 10/1965 Gustav et al.
3,271,215 A 9/1966 Hoffman
3,284,980 A 11/1966 Dinkel
3,289,371 A 12/1966 Pearson et al.
3,309,826 A * 3/1967 Zinn ..... E04B 2/7457 52/349
3,615,979 A 10/1971 Davis et al.
3,640,245 A 2/1972 Schaefer
(Continued)

FOREIGN PATENT DOCUMENTS

EP 0287918 A1 10/1988
EP 0299253 A1 1/1989
(Continued)

OTHER PUBLICATIONS

Non-final Office action mailed May 9, 2011 in U.S. Appl. No. 12/394,506 to Frank et al.
(Continued)

*Primary Examiner* — Patrick J Maestri
(74) *Attorney, Agent, or Firm* — Greer, Burns & Crain, Ltd; Philip T. Petti; Pradip Sahu

(57) ABSTRACT

A structural wall for a building is provided and includes a frame having opposing sides and a height and at least one structural panel secured to one of the sides of the frame, wherein a length of the at least one structural panel is greater than the height of the frame. An upper track is positioned over an upper end of the frame and an upper end of the at least one structural panel on each of the sides of the frame and a lower track is positioned over a lower end of the frame and a lower end of the at least one structural panel on each of the sides of the frame.

14 Claims, 6 Drawing Sheets

(56) References Cited

U.S. PATENT DOCUMENTS

| | | | | |
|---|---|---|---|---|
| 3,895,988 | A | 7/1975 | Miller | |
| 3,901,634 | A | 8/1975 | Webb et al. | |
| 3,957,556 | A | 5/1976 | Wilson et al. | |
| 3,972,972 | A | 8/1976 | Yano et al. | |
| 4,050,864 | A | 9/1977 | Komaki | |
| 4,075,805 | A | 2/1978 | Bongiovanni | |
| 4,080,766 | A * | 3/1978 | Jastrabek | E04B 2/7457 52/242 |
| 4,158,082 | A | 6/1979 | Belousofsky | |
| 4,194,946 | A | 3/1980 | Ootani et al. | |
| 4,203,788 | A | 5/1980 | Clear | |
| 4,269,006 | A | 5/1981 | Larrow | |
| 4,287,846 | A | 9/1981 | Klein | |
| 4,298,413 | A | 11/1981 | Teare | |
| 1,344,804 | A | 8/1982 | Bijen et al. | |
| 4,379,729 | A | 4/1983 | Cross | |
| 4,420,295 | A | 12/1983 | Clear et al. | |
| 4,434,119 | A | 2/1984 | Teare | |
| 4,450,022 | A | 5/1984 | Galer | |
| 4,450,128 | A | 5/1984 | Takeuchi | |
| 4,482,385 | A | 11/1984 | Satkowski et al. | |
| 4,504,335 | A | 3/1985 | Galer | |
| RE32,037 | E | 11/1985 | Clear | |
| RE32,038 | E | 11/1985 | Clear et al. | |
| 4,666,029 | A | 5/1987 | Buerkner | |
| 4,778,718 | A | 10/1988 | Nicholls | |
| 4,793,892 | A | 12/1988 | Miller et al. | |
| 4,796,559 | A | 1/1989 | Lohse | |
| 4,816,091 | A | 3/1989 | Miller | |
| 4,841,705 | A | 6/1989 | Fuhrer | |
| 4,891,071 | A | 1/1990 | Bright et al. | |
| 4,948,429 | A | 8/1990 | Arfaei | |
| 5,132,148 | A | 7/1992 | Reafler | |
| 5,221,386 | A | 6/1993 | Ensminger et al. | |
| 5,350,554 | A | 9/1994 | Miller | |
| 5,515,659 | A | 5/1996 | Macdonald et al. | |
| 5,522,926 | A | 6/1996 | Richard et al. | |
| 5,644,877 | A * | 7/1997 | Wood | E04B 2/7407 52/241 |
| 5,677,008 | A | 10/1997 | Kameya et al. | |
| 5,685,903 | A | 11/1997 | Stav et al. | |
| 5,718,797 | A | 2/1998 | Phillips et al. | |
| 5,724,783 | A | 3/1998 | Mandish | |
| 5,746,038 | A | 5/1998 | Houk | |
| 5,783,297 | A | 7/1998 | Wise et al. | |
| 5,858,083 | A | 1/1999 | Stav et al. | |
| 5,958,131 | A | 9/1999 | Asbridge et al. | |
| 5,961,900 | A | 10/1999 | Wedi | |
| 5,997,630 | A | 12/1999 | Angelskar et al. | |
| 6,068,701 | A | 5/2000 | Kohler et al. | |
| 6,119,422 | A | 9/2000 | Clear et al. | |
| 6,176,920 | B1 | 1/2001 | Murphy et al. | |
| 6,290,770 | B1 | 9/2001 | Moreau et al. | |
| 6,309,457 | B1 | 10/2001 | Guerinet et al. | |
| 6,358,603 | B1 | 3/2002 | Bache | |
| 6,437,027 | B1 | 8/2002 | Somura et al. | |
| 6,510,667 | B1 | 1/2003 | Cottier et al. | |
| 6,562,444 | B1 | 5/2003 | Gleeson et al. | |
| 6,620,487 | B1 | 9/2003 | Tonyan et al. | |
| 6,849,117 | B2 | 2/2005 | Colombet et al. | |
| 6,849,118 | B2 | 2/2005 | Kerkar et al. | |
| 6,858,074 | B2 | 2/2005 | Anderson et al. | |
| 6,873,920 | B2 | 3/2005 | Dunleavy et al. | |
| 6,875,801 | B2 | 4/2005 | Shendy et al. | |
| 6,942,727 | B2 | 9/2005 | Daczko et al. | |
| 6,976,345 | B2 | 12/2005 | Keshmiri | |
| 6,986,812 | B2 | 1/2006 | Dubey et al. | |
| 7,166,159 | B2 | 1/2007 | Colombet et al. | |
| 7,182,589 | B2 | 2/2007 | Porter | |
| 7,348,061 | B2 | 3/2008 | Girard et al. | |
| 7,445,738 | B2 | 11/2008 | Dubey et al. | |
| 7,513,768 | B2 | 4/2009 | Porter et al. | |
| 7,513,963 | B2 | 4/2009 | Frank et al. | |
| 7,524,386 | B2 | 4/2009 | George et al. | |
| 7,670,520 | B2 | 3/2010 | Dubey | |
| 7,732,032 | B2 | 6/2010 | Dubey | |
| 7,789,645 | B2 | 9/2010 | Dubey et al. | |
| 8,030,377 | B2 | 10/2011 | Dubey et al. | |
| 10,665,541 | B2 | 5/2020 | Adusumilli et al. | |
| 10,666,294 | B2 | 5/2020 | Brueggen | |
| 2001/0000738 | A1 | 5/2001 | Mathieu | |
| 2002/0004559 | A1 | 1/2002 | Hirata et al. | |
| 2002/0121230 | A1 | 9/2002 | Colombet et al. | |
| 2002/0182954 | A1 | 12/2002 | Porter | |
| 2003/0167973 | A1 | 9/2003 | Peev et al. | |
| 2004/0084127 | A1 | 5/2004 | Porter | |
| 2004/0149174 | A1 | 8/2004 | Farrington et al. | |
| 2004/0198873 | A1 | 10/2004 | Bury et al. | |
| 2004/0211342 | A1 | 10/2004 | Sprouts et al. | |
| 2004/0218462 | A1 | 11/2004 | Stephens | |
| 2004/0231567 | A1 | 11/2004 | Dulzer et al. | |
| 2004/0231916 | A1 | 11/2004 | Englert et al. | |
| 2005/0005821 | A1 | 1/2005 | Colombet et al. | |
| 2005/0061237 | A1 | 3/2005 | Dubey et al. | |
| 2005/0064055 | A1 | 3/2005 | Porter | |
| 2005/0064164 | A1 | 3/2005 | Dubey et al. | |
| 2005/0121131 | A1 | 6/2005 | Hennis et al. | |
| 2005/0139308 | A1 | 6/2005 | Aldea et al. | |
| 2005/0155689 | A1 | 7/2005 | Smolenski | |
| 2005/0219941 | A1 | 10/2005 | Christenson et al. | |
| 2005/0223651 | A1 | 10/2005 | Lange-Kornbak et al. | |
| 2005/0239924 | A1 | 10/2005 | Lettkeman et al. | |
| 2005/0252165 | A1 | 11/2005 | Hubbell et al. | |
| 2005/0274294 | A1 | 12/2005 | Brower et al. | |
| 2006/0048997 | A1 | 3/2006 | Foster et al. | |
| 2006/0105156 | A1 | 5/2006 | Simmonsen et al. | |
| 2006/0147681 | A1 | 7/2006 | Dubey | |
| 2006/0168906 | A1 | 8/2006 | Tonyan et al. | |
| 2006/0169176 | A1 | 8/2006 | Reddy et al. | |
| 2006/0174572 | A1 | 8/2006 | Tonyan et al. | |
| 2006/0243169 | A1 | 11/2006 | Mak et al. | |
| 2006/0281836 | A1 | 12/2006 | Kerns et al. | |
| 2007/0087198 | A1 | 4/2007 | Dry | |
| 2007/0110838 | A1 | 5/2007 | Porter et al. | |
| 2007/0110970 | A1 | 5/2007 | Dubey | |
| 2007/0125042 | A1 | 6/2007 | Hughes et al. | |
| 2007/0125273 | A1 | 6/2007 | Pinto | |
| 2007/0163189 | A1 | 7/2007 | Venegas | |
| 2007/0163470 | A1 | 7/2007 | Chanut et al. | |
| 2007/0175126 | A1 | 8/2007 | Tonyan et al. | |
| 2007/0228612 | A1 | 10/2007 | Durst et al. | |
| 2007/0240621 | A1 | 10/2007 | Qiao | |
| 2007/0256379 | A1 | 11/2007 | Edwards | |
| 2008/0099133 | A1 | 5/2008 | Stivender | |
| 2008/0101150 | A1 | 5/2008 | George et al. | |
| 2008/0101151 | A1 | 5/2008 | Frank et al. | |
| 2008/0110276 | A1 | 5/2008 | Frank et al. | |
| 2009/0004430 | A1 | 1/2009 | Cummins et al. | |
| 2009/0011212 | A1 | 1/2009 | Dubey et al. | |
| 2009/0239977 | A1 | 9/2009 | Dubey et al. | |
| 2011/0162306 | A1 * | 7/2011 | Stanley | E04B 7/04 52/293.3 |
| 2020/0263418 | A1 * | 8/2020 | Klein | E04B 1/947 |
| 2021/0164222 | A1 * | 6/2021 | Pilz | E04B 1/943 |
| 2021/0189721 | A1 * | 6/2021 | Klein | E04B 2/7457 |

FOREIGN PATENT DOCUMENTS

| | | | |
|---|---|---|---|
| EP | 0934915 | A1 | 8/1999 |
| FR | 951985 | A | 11/1949 |
| JP | 51115523 | A | 10/1976 |
| WO | 9213645 | A1 | 8/1992 |
| WO | 9419552 | A1 | 9/1994 |
| WO | 2005032782 | A1 | 4/2005 |
| WO | 2009114319 | A2 | 9/2009 |

OTHER PUBLICATIONS

U.S. Appl. No. 12/394,564 to Tonyan et al., filed Feb. 27, 2009 (unpublished).

Mobasher and Shah; Test Parameters for Evaluating Toughness of Glass-Fiber Reinforced Concrete Panels; ACI Materials Journal, Sep.-Oct. 1989; pp. 448-458.

(56) References Cited

OTHER PUBLICATIONS

U.S. Appl. No. 12/394,396 to Tonyan et al., filed Feb. 27, 2009 (unpublished).
Shah, Ludirdja, Daniel and Mobasher; Toughness-Durability of Glass Fiber Reinforced Concrete Systems; ACI Materials Journal Sep.-Oct. 1988; pp. 352-360.
PCT Application No. PCT/US2022/076343: International Search Report and Written Opinion dated Dec. 6, 2022 (12 pages).

* cited by examiner

STRUCTURAL LOAD-BEARING WALL

CROSS REFERENCE TO RELATED APPLICATIONS

The present non-provisional application claims priority to and the benefit of U.S. Provisional Application No. 63/245,782 filed on Sep. 17, 2021, the entire contents of which is incorporated herein.

BACKGROUND

The present invention relates generally to structural materials used for constructing buildings, and more specifically, to a structure for constructing walls of residential and commercial buildings.

Residential and commercial buildings are constructed using floor structures, walls and ceiling structures to form different floors of the buildings. The walls are secured together to construct the perimeter of each floor as well as define the internal spaces or rooms on each of the floors. Each floor of a building has a weight that is the sum of the structural materials used to construct that floor. The weight of each floor is supported at a base, called a foundation, which is formed by interconnected walls that are at or below ground level. The foundation walls are typically formed with concrete. Next, the perimeter walls forming the first floor or basement, are supported by and secured to the foundation. Each successive floor is constructed on top of the level or floor below it. Since the foundation supports the entire weight of the building, the size of the foundation is based on the size and number of floors of the building.

In addition to the foundation, each floor of a building may include load-bearing walls, which support the weight of the floor or floors above it. Load-bearing walls are framed walls commonly formed with metal or wood studs. Typically, the vertically oriented studs in the framed walls are spaced apart twelve inches, sixteen inches or twenty-four inches on center but may be spaced at any suitable distance from each other. After the load-bearing walls and non-load bearing walls are constructed to form the wall or walls of a floor or multiple floors of a building, drywall, wood or cementitious panels are attached to either surface of the load-bearing walls, i.e., to the studs forming the walls, to finish the walls. In such conventional framed structures, the frame consisting of the studs, supports the weight of the floor or floors above it and the panels attached to the walls act as a brace to help the framed walls remain flat, i.e., help to prevent the walls from moving or rotating due to the axial load from the floor or floors above it. The conventional walls also may include bracing, such as channel bracing, that extends through openings in the studs and is attached to the studs to help keep the walls flat. Construction materials can be expensive and the cost depends on the supply and demand for the materials. The capacity of these load-bearing walls is limited and stronger load-bearing walls would make buildings stronger and less costly, i.e., more efficient.

Therefore, there is a need for cost effective building materials that have sufficient strength to support the weight of the floors of a building.

SUMMARY

The above-listed need is met or exceeded by the present structural wall that includes building panels secured to a frame where the building panels have a length that is greater than a height of the frame, i.e., studs, so that the building panels support the axial load from a building structure or structures above the wall.

In an embodiment, a structural wall for a building is provided and includes a frame having opposing sides and a height and at least one structural panel secured to one of the sides of the frame, wherein a length of the at least one structural panel is greater than the height of the frame. An upper track is positioned over an upper end of the frame and an upper end of the at least one structural panel on each of the sides of the frame and a lower track is positioned over a lower end of the frame and a lower end of the at least one structural panel on each of the sides of the frame.

In another embodiment, a structural wall for a building is provided and includes a frame having opposing sides and a height and at least one structural panel secured to both sides of the frame, wherein a length of the at least one structural panel is greater than the height of the frame. An upper track is positioned over an upper end of the frame and an upper end of the at least one structural panel on each of the sides of the frame and a lower track is positioned over a lower end of the frame and a lower end of the at least one structural panel on each of the sides of the frame.

DETAILED DESCRIPTION

Figure 1:
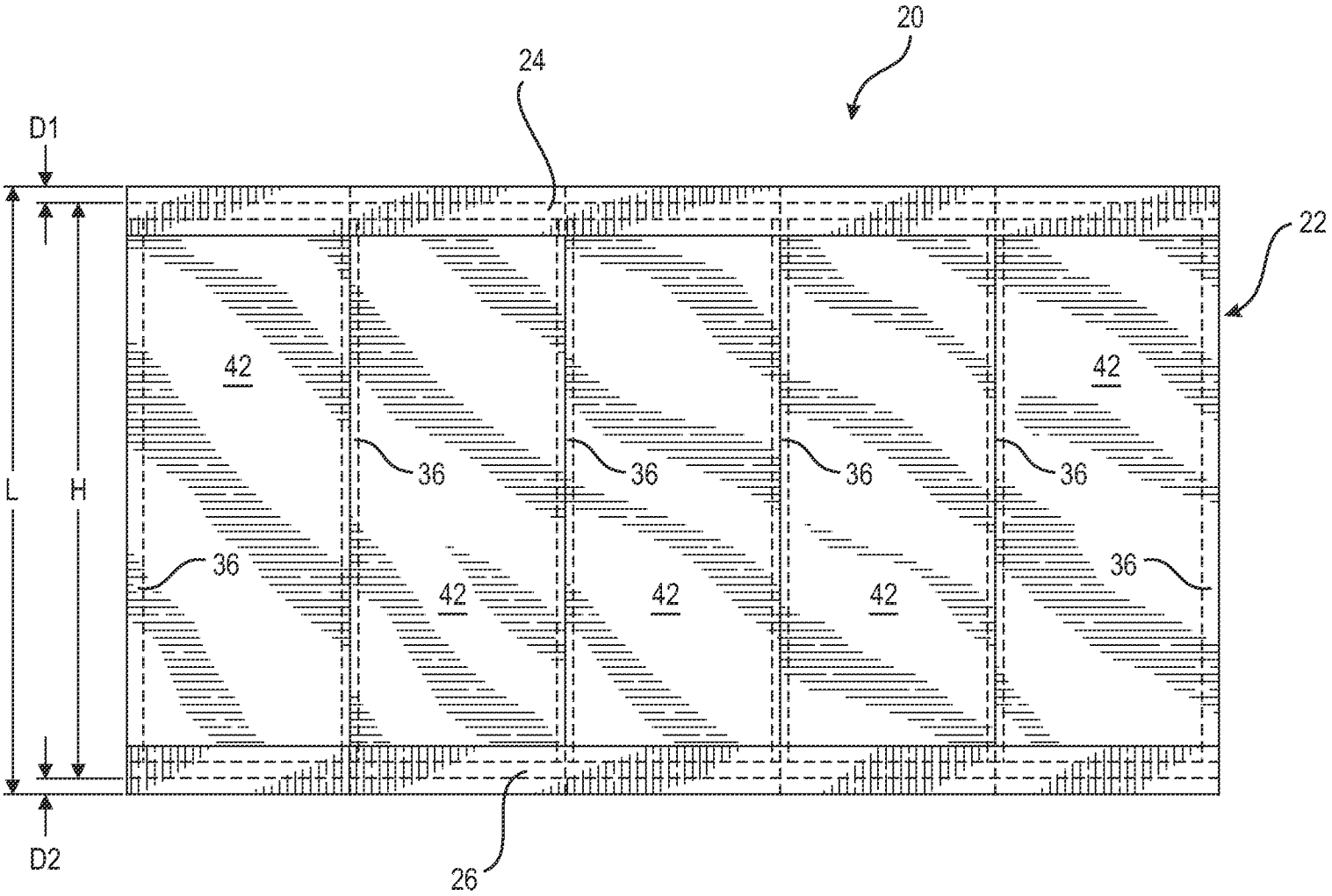
FIG. 1 is a front view of an embodiment of the present structural wall.
Figure 2:
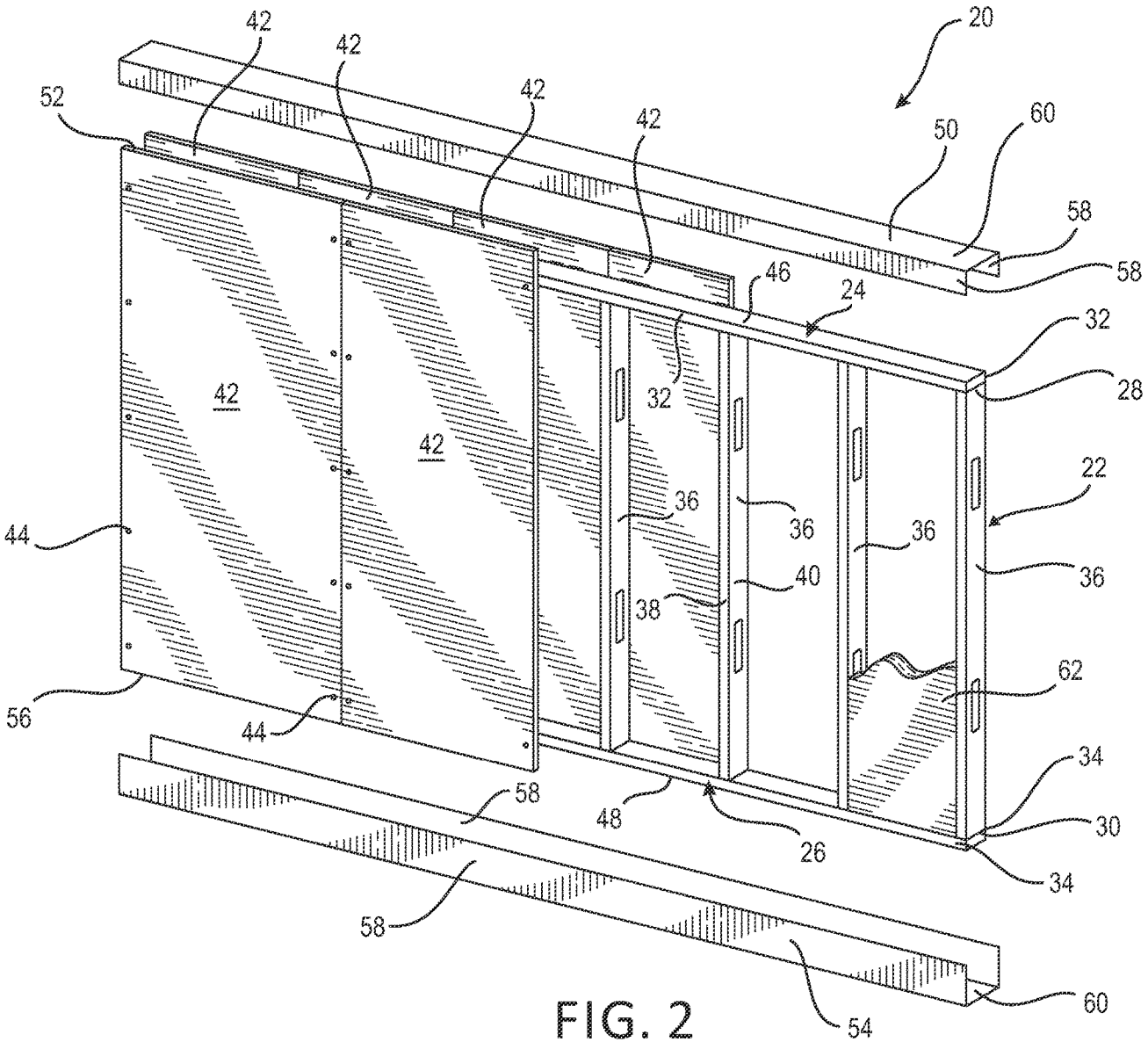
FIG. 2 is an exploded perspective view of the wall of FIG. 1.

Referring now to FIGS. 1 and 2, the present structural wall generally indicated as 20 is constructed to be a load-bearing wall in which an axial load on the wall is applied primarily to cementitious panels secured to the wall instead of to the frame.

In an embodiment, the structural wall 20 includes a frame 22 having an upper support member 24 and a lower support member 26 that are horizontally oriented, and preferably made of steel. The upper and lower support members 24, 26 each have a U-shape and form a track with a recessed area 28 and 30 defined between opposing sidewalls 32, 34 of the upper and lower support members. In this embodiment, the width (or depth) of the upper and lower support members 24, 26, i.e., the distance between outer surfaces of the sidewalls, is 3.5 inches, but may be any suitable width. Also as stated above, the upper and lower support members 24, 26 are preferably made of steel. It is also contemplated that the upper and lower support members 24, 26 may be made of wood, a composite material or any suitable material or combination of materials. In this embodiment, the upper and lower support members 24, 26 preferably have a length of 8 to 10 feet but may be any suitable length.

As shown, the frame 22 also includes several intermediate support members 36 that are vertically oriented and extend between the upper and lower support members 24, 26. The intermediate support members 36 each have an asymmetric C-shape or U-shape defined by opposing sidewalls 38 and an end wall 40 extending between the sidewalls. In the illustrated embodiment, each of the ends of the intermediate support members 36 are respectively secured to the upper and lower support members 24, 26 by inserting the ends of the intermediate support members respectively in the recessed areas 28, 30 and securing the intermediate support members 36 in place on the upper and lower support members 24, 26 by a friction fit between the sidewalls 32, 34 of the upper and lower support members. In another embodiment, the ends of the intermediate support members 36 are secured to the upper and lower support members 24, 26 by fasteners, such as nails, bolts or screws. Similar to the upper and lower support members 24, 26, the intermediate support members 36 are preferably made of steel, but may be made of wood, a composite material or any suitable material or combination of materials. In this embodiment, the upper support member 24, the lower support member 26 and the intermediate support members 36 are each steel studs, preferably having dimensions of three and one-half inches (3.5 in.) by one and one-half inches (1.5 in.), but may have any suitable dimensions. In another embodiment, the upper support member 24, the lower support member 26 and the intermediate support members 36 are each wood studs, preferably having dimensions of two (2.0) inches by (4.0) four inches, but may have any suitable dimensions. Within the frame, the intermediate support members 36 are preferably spaced apart sixteen (16.0) inches on center defined by a central longitudinal axis of each intermediate support member, but also may be spaced apart 19.2 inches or twenty-four (24.0) inches on center or any suitable distance between the centers of each of the intermediate support members.

As shown in FIG. 2, the structural wall 20 includes a plurality of building panels, and more specifically, a plurality of cementitious panels 42 secured to the frame by fasteners 44, such as nails, bolts or screws. Each cementitious panel 42 is a structural cementitious panel as described in U.S. Pat. Nos. 6,986,812; 7,445,738; 7,670,520; 7,789,645; and 8,030,377, which are all incorporated herein by reference. It should be appreciated that the panel 42 may be a Portland-based cementitious panel, a magnesium oxide based cementitious panel or any suitable cementitious panel or a panel made of any suitable material or combination of materials. In this embodiment, the cementitious panel 42 is made of a cement-gypsum binder including alkali-resistant fiberglass fibers and preferably each have a length of eight feet, a width of four feet and a thickness of a ½ inch (0.5 inches). It should be appreciated that the cementitious panels 42 may have any suitable length and width. Further, the cementitious panels 42 may have a thickness of ¼ inch (0.25 in), ⅜ inches (0.375 inches), ½ inch (0.5 inch), ⅝ inch (0.625 inch), ¾ inch (0.75 in), 1.0 in or any suitable thickness.

In conventional structural walls, the panels attached to the frame each have a length that is equal to a height of the frame such that the upper and lower surfaces of the panels are substantially flush with the upper and lower surfaces of the frame. In this way, the frame supports the axial load, i.e., weight, of the structure or structures that are constructed above the structural wall or walls. The panels on the conventional structural walls thereby do not support the weight of the above structures but instead, brace the frame to help prevent buckling of the structural wall due to the axial load, and also finish the inside and/or outside surfaces of the frame for aesthetic purposes.

Figure 3:
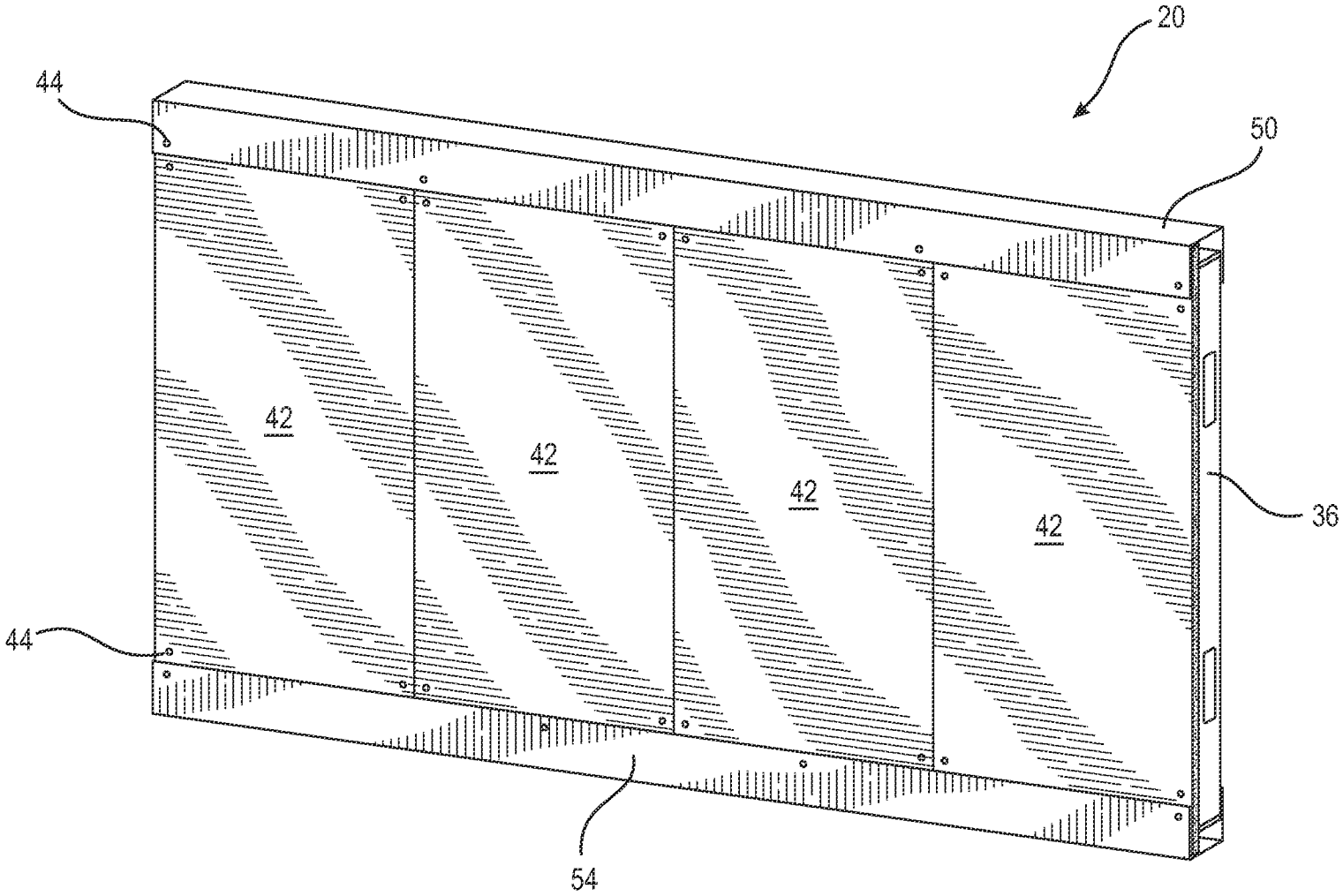
FIG. 3 is a perspective view of another embodiment of the wall.

The present structural wall 20 is constructed so that the ends of the cementitious panels 42 extend a designated distance D1 above the upper surface 46 of the frame 22 and a designated distance D2 below the lower surface 48 of the frame 22 as shown in FIG. 2. In other words, the frame 22 is constructed to have a height H defined by the distance between the upper surface and the lower surface of the frame 22, that is less than a height of a conventional frame for a structural wall. In the illustrated embodiment, each panel 42 has a length L that is greater than the height H of the frame 22 such that the panels each extend above the frame by one inch (D1) and below the frame by one inch (D2) as shown in FIGS. 1 and 3. It is also contemplated that the panels 42 may extend above and below the frame 22 by less than one inch or by more than one inch. Further, the distance D1 that the panels 42 extend above the frame 22 and the distance D2 the panels 42 extend below the frame 22 may be the same distance or different distances. For example, the panels 42 may extend above the frame 22 by one inch and below the frame 22 by two inches.

Referring to FIG. 2, the cementitious panels 42 are preferably secured to both sides of the frame 22. In this way, the load applied to the wall 20 is supported by two sets or two layers of the cementitious panels 42. In another embodiment shown in FIG. 5, the wall 21 includes cementitious panels 42 secured to one side of the frame 22. In this embodiment, the cementitious panels 42 may be secured to an inside surface of the frame 22 or to the outside surface of the frame 22.

Figure 4:
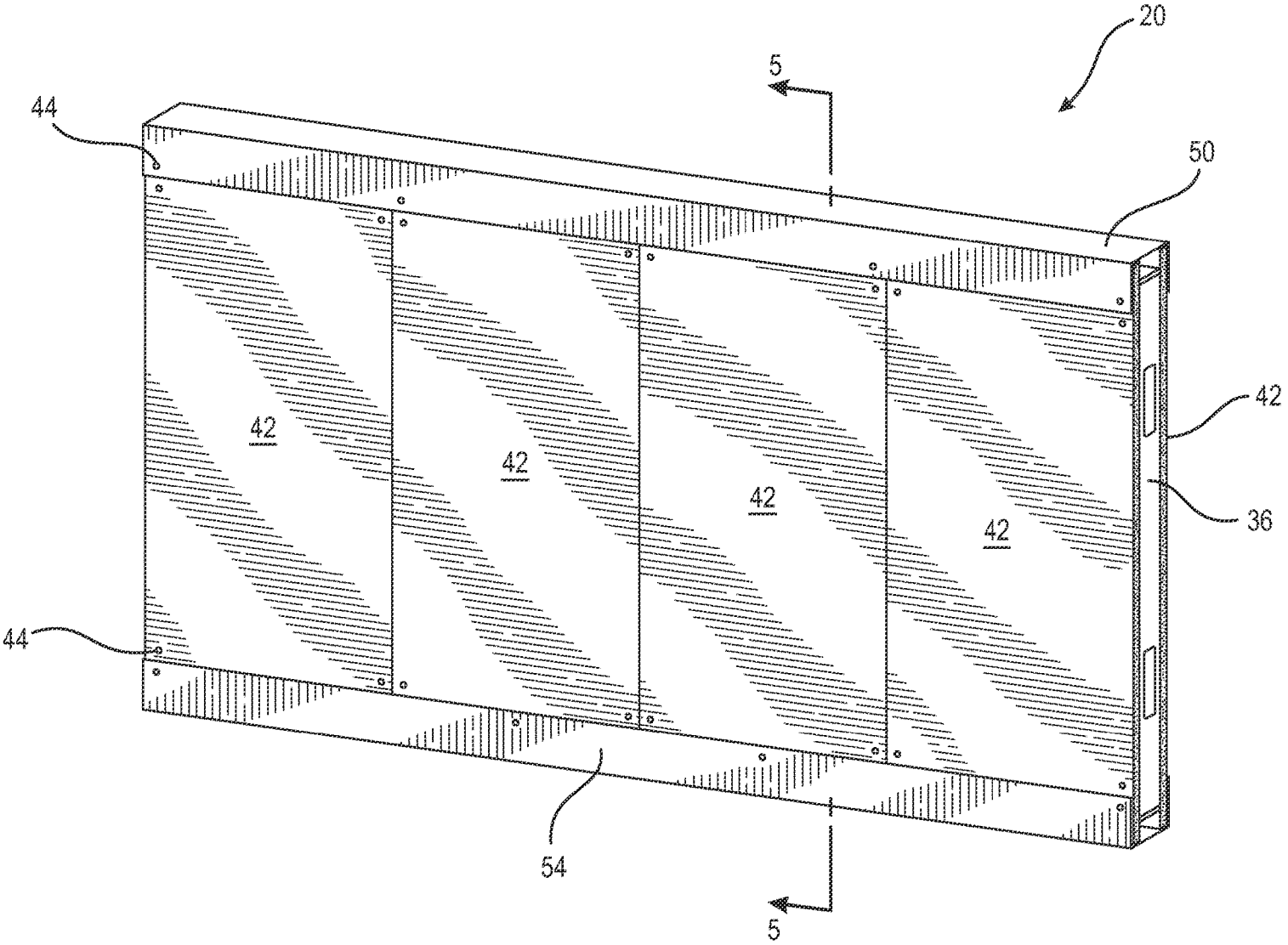
FIG. 4 is a perspective view of the wall of FIG. 1.
Figure 5:
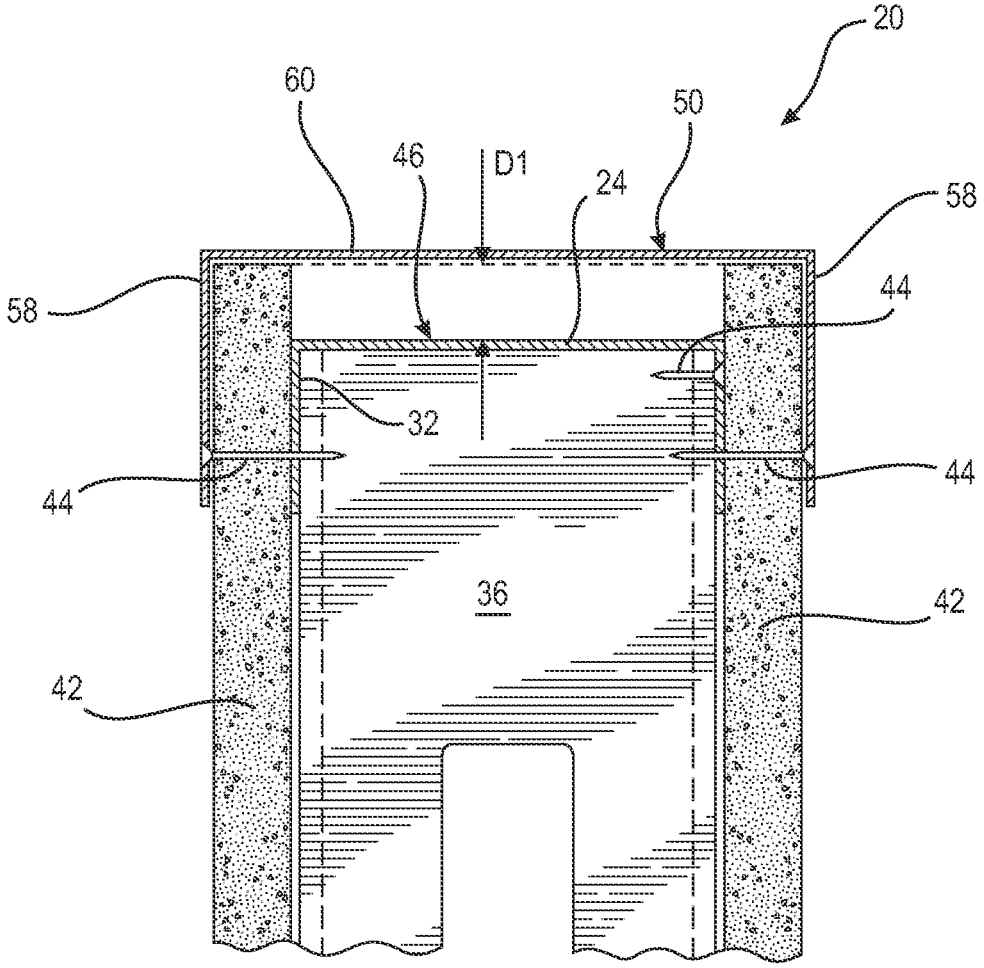
FIG. 5 is a fragmentary cross-section view of the wall taken substantially along line 5-5 in FIG. 4 in the direction generally indicated.

As shown in FIGS. 2, 4 and 5, an upper track 50 is placed over the upper surfaces 52 of the cementitious panels 42 and the upper support member 24. Similarly, a bottom track 54 is placed over the lower surfaces 56 of the cementitious panels 42 and the lower support member 26. The upper and lower tracks 50, 54 each have sidewalls 58 and an end wall 60 extending between and secured to the sidewalls. In the illustrated embodiment, the upper and lower tracks 50, 54 preferably each have a width of 5.0 inches, i.e., the distance between the outer surfaces of the sidewalls 58. It should be appreciated that the width of the upper and lower tracks 50, 54 may be any suitable width such that the upper and lower tracks 50, 54 respectively cover or cap the upper and lower surfaces 52, 56 of the cementitious panels 42 and the upper and lower support members 24, 26. In this embodiment, the upper and lower tracks 50, 54 are secured in place on the upper and lower ends of the cementitious panels 42 by connectors 44, such as nails or screws, that extend through the upper and lower tracks 50, 54, the cementitious panels 42 and the upper and lower support members 24, 26. In another embodiment, the upper and lower tracks 50, 54 are secured over the upper and lower ends of the cementitious panels 42 by a friction fit where one of the sidewalls 58 extends along an outer surface of the cementitious panels on both sides of the frame 22. The upper and lower tracks 50, 54 may also be secured to the upper and lower ends of the cementitious panels 42 using an adhesive.

As shown in FIGS. 2 and 4, after the upper and lower tracks 50, 54 are placed on and secured over the upper and lower surfaces 52, 56 of the cementitious panels 42 and the upper and lower support members 24, 26, the upper and lower tracks act as a cap and bearing plate for the wall 20. In this way, the axial load from the building structure or structures above the wall 20 is applied to the upper track 50, which distributes the load to the cementitious panels 42 on each side of the frame 22. Thus, the cementitious panels 42 support the axial load and the frame 22 braces the cementitious panels 42 to help keep the panels flat against the frame, i.e., help to avoid twisting, rotating or movement of the panels 42 relative to the frame 22 due to the axial load.

Figure 6:
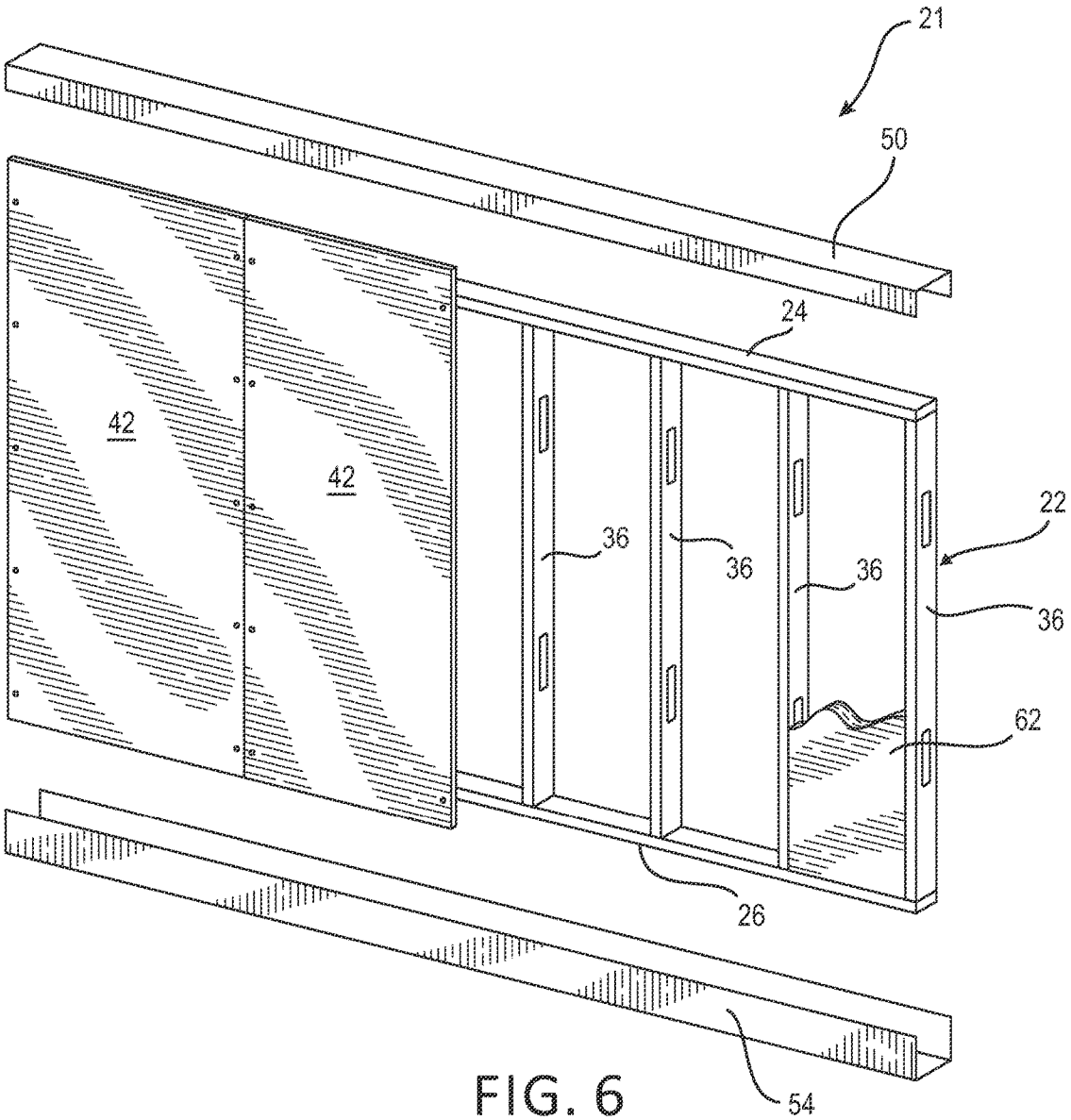
FIG. 6 is an exploded perspective view of the wall of FIG. 3.

As shown in FIGS. 2 and 6, in an embodiment, an insulating material 62 is inserted between the intermediate support members 36 and between the cementitious panels 42 in the two-sided structural wall 20 (FIG. 2) or adjacent to cementitious panels 42 in the one-sided structural wall 21 (FIGS. 3 and 6) to help control temperature, act as sound proofing and/or to further brace and stabilize the panels. It should be appreciated that an insulating material 62, a semi-rigid material, a rigid material or any suitable material or combination of materials may be placed in the space between the intermediate support members 36 and the cementitious panels 42.

The structural wall in the above embodiments has been tested with different axial loads. In the tests, the double-sided structural wall 20, which has cementitious panels 42 on both sides of the frame 22, supported an axial load of over 25,000 pounds per linear foot of the wall. Tests were also performed on the structural wall 21 having cementitious panels on one side of the frame 22 (one-sided structural wall) as shown in FIGS. 3 and 6.

During testing, a single 2 ft wide by 8 ft long sheet of a ¾ inch thick cementitious panel 42 (structural fiber-cement panel) was secured to two intermediate support members 36 or studs, with one of the intermediate support members 36 being on each side of the cementitious panel 42, where the cementitious panel was secured to the intermediate support members by fasteners positioned at a distance of one foot from the upper end of the panel 42, i.e., in the middle of the panel. The intermediate support members 36 were cut 1¼" shorter on each end than the cementitious panel 42, and primarily used to brace and keep the cementitious panel straight or flat as described above. An axial load was applied to the top end or top surface of the cementitious panel 42 and adjusted to determine the maximum axial load capacity of the structural wall 21. The test results found that the one-sided structural wall 21, i.e., having cementitious panels on one side of the frame, has an axial load capacity of 38,980 lbs. As such, the axial load capacity of the present one-sided structural wall 21 is twice the axial load capacity of a conventional steel stud wall (per 2 linear feet of wall). Similarly, the axial load capacity of the present two-sided structural wall 20, i.e., having cementitious panels that are two feet wide by eight feet long on both sides of the frame, is over four times the axial load capacity of a conventional steel stud wall. Thus, the enhanced axial load capacity of the present structural wall has significant advantages over conventional structural walls and reduces costs associated with constructing such walls.

While particular embodiments of the present structural wall have been described herein, it will be appreciated by those skilled in the art that changes and modifications may be made thereto without departing from the invention in its broader aspects and as set forth in the following claims.

The invention claimed is:

1. A structural wall for a building, the wall comprising:

a frame having opposing sides and a height, said frame including an upper support member, a lower support member and at least one intermediate support member extending between the upper support member and the lower support member;

at least one structural panel secured to one of the sides of the frame, wherein a length of said at least one structural panel is greater than said height of said frame;

an upper track positioned over and spaced from said upper support member of said frame, said upper track contacting said upper end of said at least one structural panel; and a lower track positioned over and spaced from said lower support member of said frame, said lower track contacting said lower end of said at least one structural panel.

2. The structural wall of claim 1, wherein said at least one structural panel is a cementitious panel.

3. The structural wall of claim 1, wherein said at least one structural panel is a wood panel.

4. The structural wall of claim 1, wherein a distance between an upper surface of said at least one structural panel and an upper surface of said frame and a distance between a bottom surface of said at least one structural panel and said bottom surface of said frame are each greater than one inch.

5. The structural wall of claim 1, wherein a distance between an upper surface of said at least one structural panel and an upper surface of said frame and a distance between a bottom surface of said at least one structural panel and said bottom surface of said frame are each equal to one inch.

6. The structural wall of claim 1, wherein at least one of said upper track and said lower track has opposing sidewalls and an upper wall extending between said sidewalls to form a U-shape.

7. A structural wall for a building, the wall comprising:

a frame having opposing sides and a height, said frame including an upper support member, a lower support member and at least one intermediate support member extending between the upper support member and the lower support member;

a plurality of structural panels secured to both sides of the frame, wherein a length of each of said structural panels being greater than said height of said frame;

an upper track positioned over and spaced from said upper support member of said frame, said upper track only-contacting said upper ends of said structural panels; and a lower track positioned over and spaced from said lower support member of said frame, said lower track contacting said lower ends of said structural panels.

8. The structural wall of claim 7, wherein at least one of said structural panels is a cementitious panel.

9. The structural wall of claim 7, wherein at least one said structural panels is a wood panel.

10. The structural wall of claim 7, wherein a distance between an upper surface of each of said structural panels and an upper surface of said frame and a distance between a bottom surface of each of said structural panels and said bottom surface of said frame are each greater than one inch.

11. The structural wall of claim 7, wherein a distance between an upper surface of each of said structural panels and an upper surface of said frame and a distance between a bottom surface of each of said structural panels and said bottom surface of said frame are each equal to one inch.

12. The structural wall of claim 7, wherein at least one of said upper track and said lower track has opposing sidewalls and an upper wall extending between said sidewalls to form a U-shape.

13. The structural wall of claim 1, wherein said upper track and said lower track are the same size and shape.

14. The structural wall of claim 7, wherein said upper track and said lower track are the same size and shape.

* * * * *